US006241232B1

(12) United States Patent
Schmitt et al.

(10) Patent No.: US 6,241,232 B1
(45) Date of Patent: Jun. 5, 2001

(54) APPARATUS AND METHOD FOR FOLDING A TEXTILE FABRIC LENGTH

(75) Inventors: Hermann Schmitt, Grossbardorf; Siegfried Henze, Hohenroth, both of (DE)

(73) Assignee: TEXPA Maschinenbau GmbH & Co., Saal (DE)

( * ) Notice: Subject to any disclaimer, the term of this patent is extended or adjusted under 35 U.S.C. 154(b) by 0 days.

(21) Appl. No.: 09/337,818

(22) Filed: Jun. 22, 1999

(30) Foreign Application Priority Data

Mar. 22, 1999 (DE) ..... 299 05 112 U

(51) Int. Cl.[7] ..... B65H 45/16

(52) U.S. Cl. ..... 270/30.01; 270/39.01; 270/39.08; 493/444; 493/413; 493/458; 493/937; 493/938

(58) Field of Search ..... 493/937, 938, 493/444, 413, 414, 430, 433, 434, 435, 441, 442, 443, 458; 270/30.01, 32, 39.01, 39.05, 39.08

(56) References Cited

U.S. PATENT DOCUMENTS

| | | | | |
|---|---|---|---|---|
| 240,390 | * | 4/1881 | Cross | 493/444 |
| 275,154 | * | 4/1883 | Cross | 493/444 |
| 2,637,551 | * | 5/1953 | Young | 493/937 X |
| 3,229,973 | * | 1/1966 | Cornwall | 493/937 X |
| 3,703,280 | * | 11/1972 | Wier | 493/937 X |
| 3,752,470 | * | 8/1973 | Buss et al. | 493/937 X |
| 3,797,820 | * | 3/1974 | McDermott | 493/937 X |
| 4,057,241 | * | 11/1977 | Buss et al. | 493/937 X |
| 4,548,595 | * | 10/1985 | Heater et al. | 493/937 X |
| 5,540,647 | * | 7/1996 | Weiermann et al. | 493/444 |
| 5,876,027 | * | 3/1999 | Fukui et all. | 493/444 X |

* cited by examiner

*Primary Examiner*—Christopher P. Ellis
*Assistant Examiner*—Patrick Mackey
(74) *Attorney, Agent, or Firm*—McGlew & Tuttle, P.C.

(57) ABSTRACT

An apparatus (1) for folding a textile fabric length (11) is provided with at least two transport belts (2, 3) which can be driven in opposite directions, wherein a gap (27) is disposed between the transport belts (2, 3), through which gap the fabric length (11) can be drawn while forming a fold when the transport belts (2, 3) are driven in opposite directions. In order to achieve greater folding accuracy, a gripping member (4) is disposed above the two transport belts (2, 3), which member can move substantially parallel to the upper side of the transport belts (2, 3) and can be brought to lie between the front and the back end (12, 23) of the unfolded fabric length (11) with a fixing action.

15 Claims, 4 Drawing Sheets

APPARATUS AND METHOD FOR FOLDING A TEXTILE FABRIC LENGTH

FIELD OF THE INVENTION

The invention relates to an apparatus for folding a textile fabric length with at least two transport belts which can be driven in opposite directions, wherein a gap is disposed between the transport belts, through which gap the fabric length can be drawn while forming a fold when the transport belts are driven in opposite directions. The invention also relates to a method for operating the apparatus.

BACKGROUND OF THE INVENTION

Apparatus of this type are used, for example, although by no means exclusively, for folding bed sheets so that these can be packed ready for sale after having been sewn. Such apparatus comprise at least two transport belts which can be driven in opposite directions and are disposed such that a gap is produced between them. In order to fold the fabric length, this is laid out on the transport belts, coming to lie above the gap between the transport belts. The fabric length is drawn into the gap through the two transport belts being driven in opposite directions, so that the fabric length is folded once. More than two transport belts may be disposed one behind the other, depending on the number of times the fabric length has to be folded, with each two transport belts forming a gap for folding the fabric length. The fabric lengths can thus be folded several times in succession by driving the various transport belts accordingly.

The disadvantage of the known apparatus lies in the fact that relatively large tolerances of the alignment of the individual fabric layers occur when folding the fabric lengths. A particular result of this is that, instead of the lateral edges of the fabric lengths coming to lie in an optimum parallel position on top of one another following folding, an angular offset starting from the folding edge occurs between the lateral edges. Errors of this kind in the alignment of the edges are particularly detrimental when the fabric length is folded several times, as folding errors increase in subsequent folding stages.

SUMMARY AND OBJECTS OF THE INVENTION

The primary object of the present invention is to provide an apparatus with which textile fabric lengths can be folded more accurately. A further object of the present invention is to provide a method for operating the apparatus according to the invention.

According to the invention, an apparatus is provided for folding a textile fabric length, with at least two transport belts which can be driven in opposite directions. A gap is disposed between the transport belts, through which gap the fabric length can be drawn while forming a fold when the transport belts are driven in opposite directions. A gripping member is disposed above the two transport belts, which member can move substantially parallel to the upper side of the transport belts. This gripping member can be brought to lie between the front and the back end of the unfolded fabric length with a fixing action. After the gripping member has been fixed in the central region of the fabric length, it is moved parallel to the upper side of the transport belts. The fabric length is as a result folded for the first time. In this case the folding edge extends along the contact points or contact line between the gripping member and the fabric length. After the gripping member has been moved laterally up to an end point, the fabric length comes to lie in two superimposed layers on the transport belts. After the gripping member has been disengaged from the fabric length, the latter can be folded again in the conventional manner by driving the transport belts accordingly.

The unfolded fabric length can in principle be fed to the apparatus in any desired manner before the gripping member is fixed. According to a preferred embodiment of the invention, the apparatus comprises a feed device by means of which the unfolded fabric length can be fed in a freely suspended manner, at least in certain regions, into the region at the side of the transport belts. The freely suspended feed of the fabric length enables the latter to be aligned in optimum fashion and, in particular, without creases, before the gripping member is fixed. As the fabric length hangs smoothly under its own weight, there cannot be any unwanted displacement of individual regions of the fabric length relative to one another.

It is particularly easy to form the feed device like a conveyor belt whose end which points towards the apparatus is disposed at least a little above the apparatus and at least at a short lateral distance from the latter. The fabric length is laid out flat on this conveyor belt. The conveyor belt is then driven such that the front edge of the fabric length is conveyed further in the direction of the apparatus and, upon reaching the end of the conveyor belt, hangs down between the latter and the apparatus. The fabric length is then conveyed further on the conveyor belt until the desired folding edge region of the fabric length and the gripping member lie opposite one another. The fabric length can subsequently be folded as desired through the use according to the invention of the gripping member.

According to a preferred embodiment of the invention, a mobile pushing mechanism is disposed below the feed device, which pushing mechanism can be brought to lie on the side of the unfolded fabric length which points away from the apparatus. The fabric length can be brought to lie against the gripping member by moving the pushing mechanism, so that the gripping member can be securely fixed to the fabric length.

It is of particular advantage if the shape of the edge of the unfolded fabric length at the front end can be influenced by the design and/or direction of movement of the part of the mobile pushing mechanism which can be brought to lie against the unfolded fabric length. For this purpose, for example, projecting regions may be molded on in the outer region of a contact edge of a pushing mechanism which comes to lie against the fabric, so that the corners of the unfolded fabric length at the front edge are raised slightly when the contact edge lies against the fabric length. This raising action can prevent the corners from jutting out after the folding operation has been completed.

According to a preferred embodiment of the invention, at least one measuring member is disposed below the feed device, by means of which member the vertical distance between the front end of the fabric length and the gripping member can be determined. By evaluating the signals from the measuring member, the drive of the feed device can be precisely controlled such that the region of the desired folding edge at the unfolded fabric length is disposed exactly opposite the gripping member.

According to a preferred embodiment, the measuring member is formed like a light barrier. A signal can be delivered as soon as the front end of the fabric length is conveyed into the region of the light barrier, so that the feed device is stopped either immediately or at the end of a certain after-running time.

The invention also relates to a method for folding a fabric length with the use of an apparatus according to the invention. The fabric length is fed laterally to the transport belts in a freely suspended manner in a first method step. The gripping member is then brought to lie against the unfolded fabric length between the front and the back end of the fabric length with a fixing action. The gripping member is subsequently moved laterally up to an end point while forming a fabric length which is folded once and lies in two layers, at least in certain regions. Once the end point has been reached, the gripping member is disengaged from the fabric length, so that the folded fabric length comes to lie on the transport belts. Finally, the fabric length, having already been folded once, is folded again by operating the transport belts in the conventional manner.

According to an advantageous development of the method according to the invention, after reaching the end point and before the fabric length is disengaged, the gripping member is moved in the opposite direction while forming a fabric length which is folded twice and lies in four layers, at least in certain regions.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
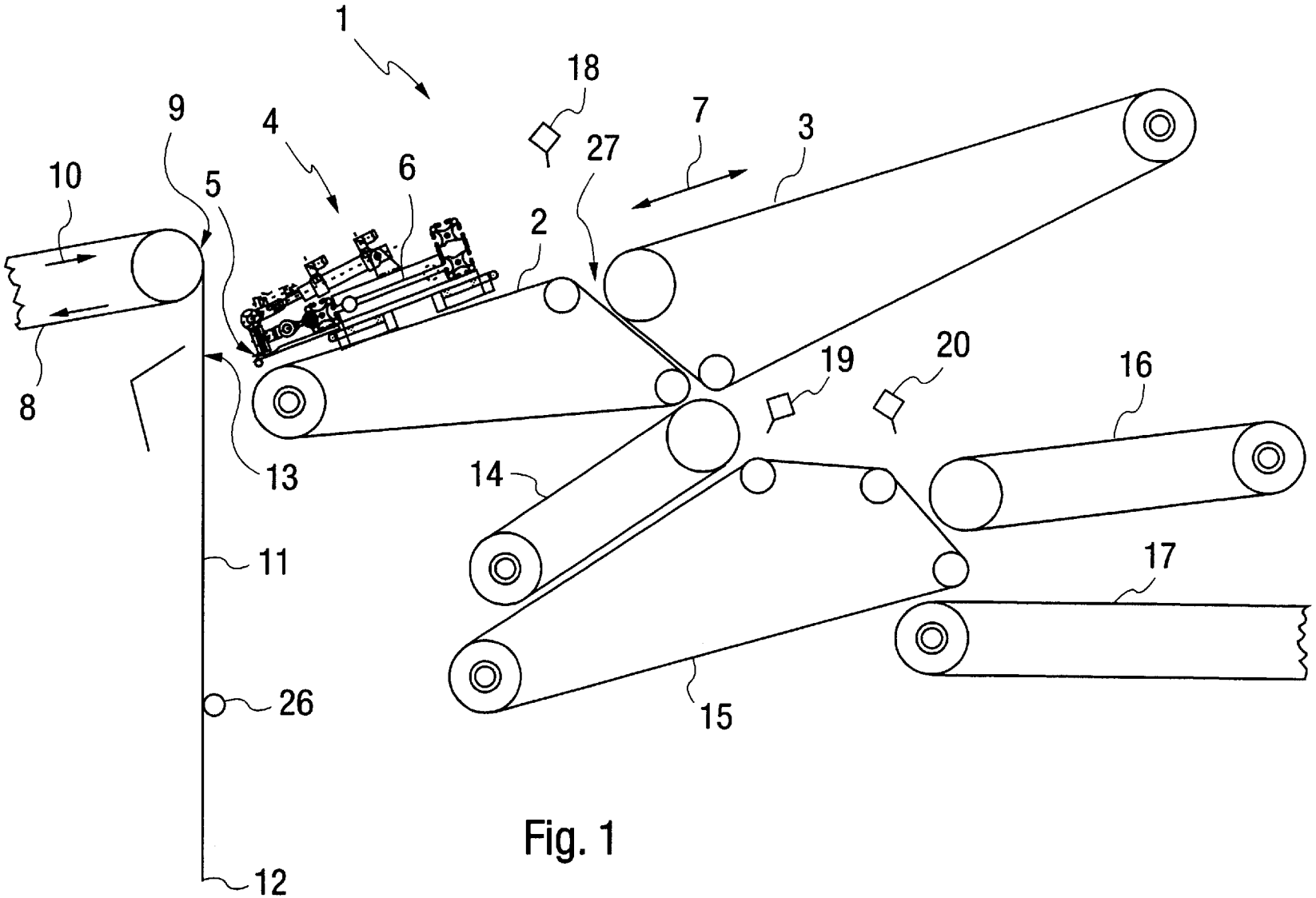
FIG. 1 is a side view of an apparatus according to the invention during a first method phase.

Referring to the drawings in particular, FIG. 1 shows an apparatus 1 according to the invention with two transport belts 2 and 3 and a gripping member 4 which is disposed above these and can move parallel to the upper side of the transport belts 2 and 3. The gripping member 4 consists substantially of gripping nippers 5, which can be closed pneumatically, and of a carriage 6, which can move on two rails, these not being shown. The carriage 6 can be driven to move according to the movement arrow 7 parallel to the upper side of the transport belts 2 and 3.

In the embodiment represented in FIG. 1 the feed device is formed like a conveyor belt 8, the right-hand end 9 of which is disposed above and at a lateral distance from the opposite end of the transport belt 2. A fabric length 11, which is initially laid out on the upper side of the conveyor belt 8, can be fed in a freely suspended manner into the region at the side of the transport belts 2 and 3 by driving the conveyor belt 8 in the direction of the movement arrow 10. The conveyor belt 8 is in this case driven until the front end 12 of the fabric length 11 passes a light barrier 26, only part of which is represented. After the end 12 has passed the light barrier 26, the conveyor belt 8 is driven further for a defined after running time until a region 13, which is subsequently to form the desired first folding edge, lies exactly opposite the gripping nippers 5.

The transport belts 14, 15, 16 and 17 disposed below the transport belts 2 and 3 serve to fold the fabric length 11 in subsequent folding stages. The feed devices 18, 19 and 20 are each disposed above a gap formed by two transport belts, these feed devices each serving to feed the fabric length into a gap. The function and operating mode of the components 2, 3 and 14 to 20 are known from the prior art.

Figure 2:
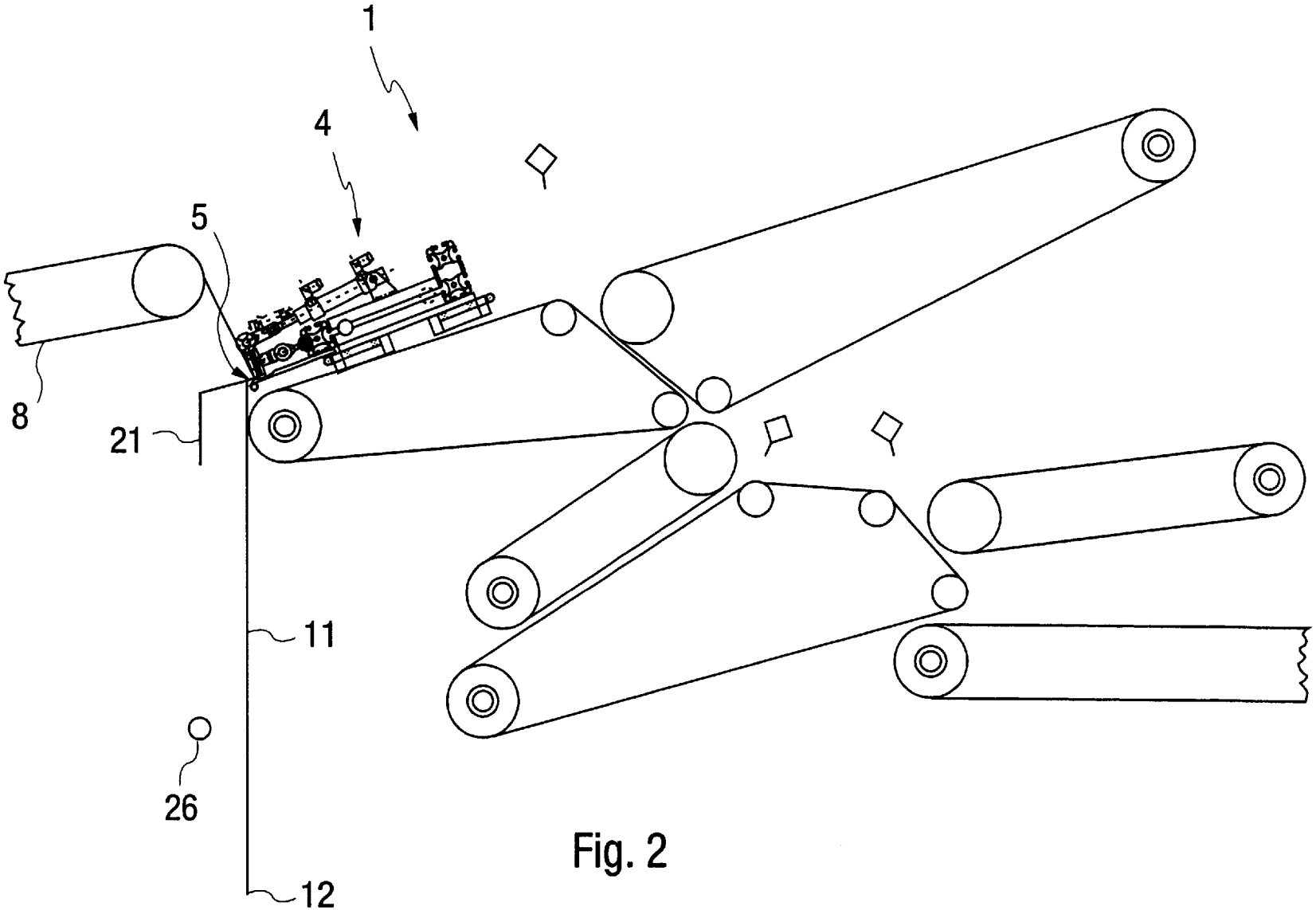
FIG. 2 is a side view of the apparatus according to FIG. 1 in a second method phase.

FIG. 2 shows the apparatus 1 in a subsequent method phase, while the gripping member 4 is brought to lie against the fabric length 11 with a fixing action by means of the gripping nippers 5. Once the desired folding edge region 13 and the gripping nippers 15 lie exactly opposite one another, a mobile pushing mechanism 21 is brought into use such that it is firstly brought to lie against the unfolded fabric length 11 and, through being further advanced, brings the fabric length 11 into the zone of action of the gripping nippers 5. As soon as the fabric length 11 is located in the zone of action of the gripping nippers 5, the gripping nippers 5 are closed, so that the fabric length 11 is fixed in the region of the desired folding edge 13.

Figure 3:
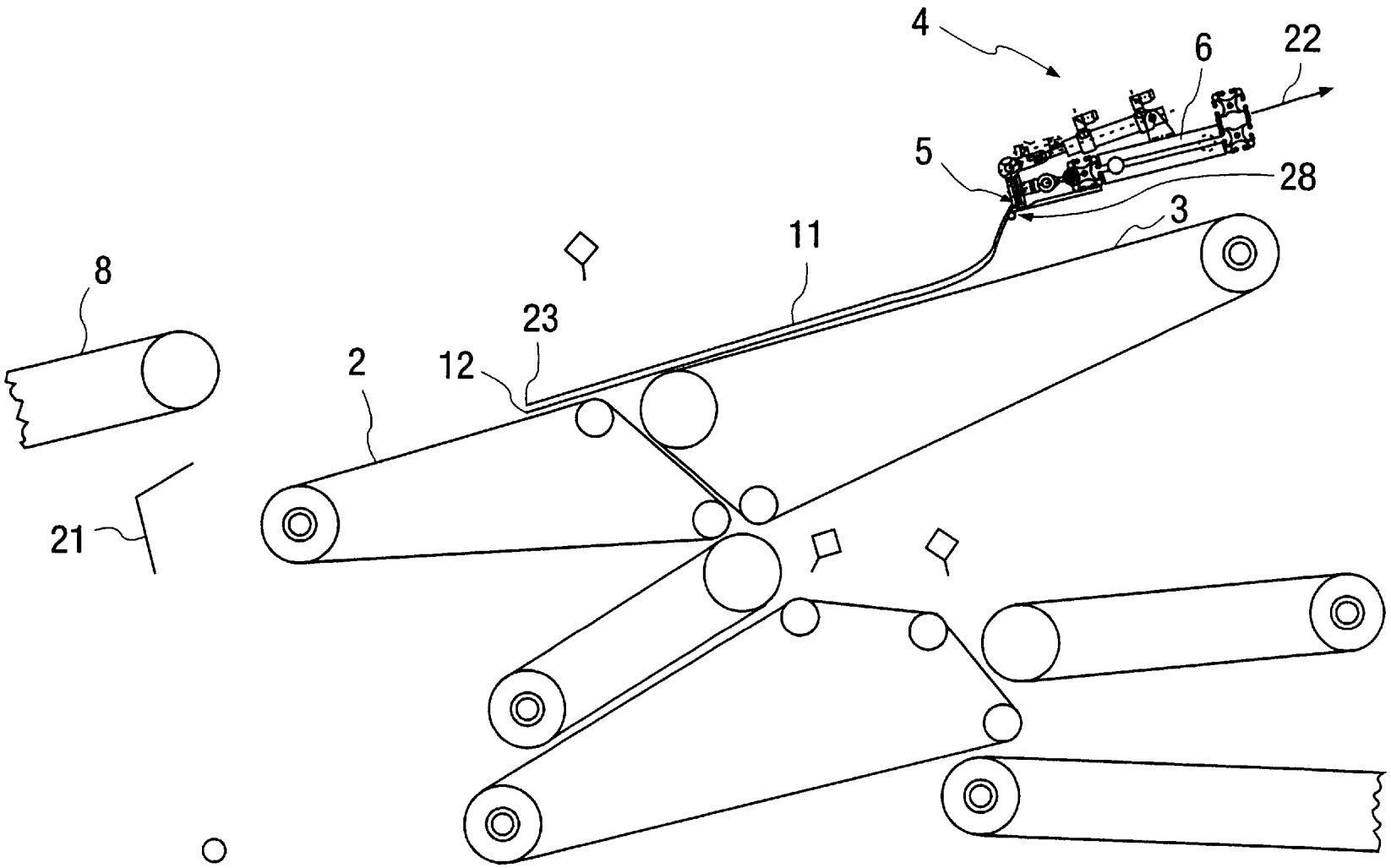
FIG. 3 is a side view of the apparatus according to FIG. 1 in a third method phase.

As can be seen in FIG. 3, the carriage 6 of the gripping member 4 is moved in the direction of the movement arrow 22 up to an end point 28 after the gripping nippers 5 have closed, so that the fabric length 11 comes to lie on the transport belts 2 and 3 in two superimposed layers. In the represented embodiment of the invention the back end 23 of the fabric length 11 comes to lie exactly above the front end 12.

Figure 4:
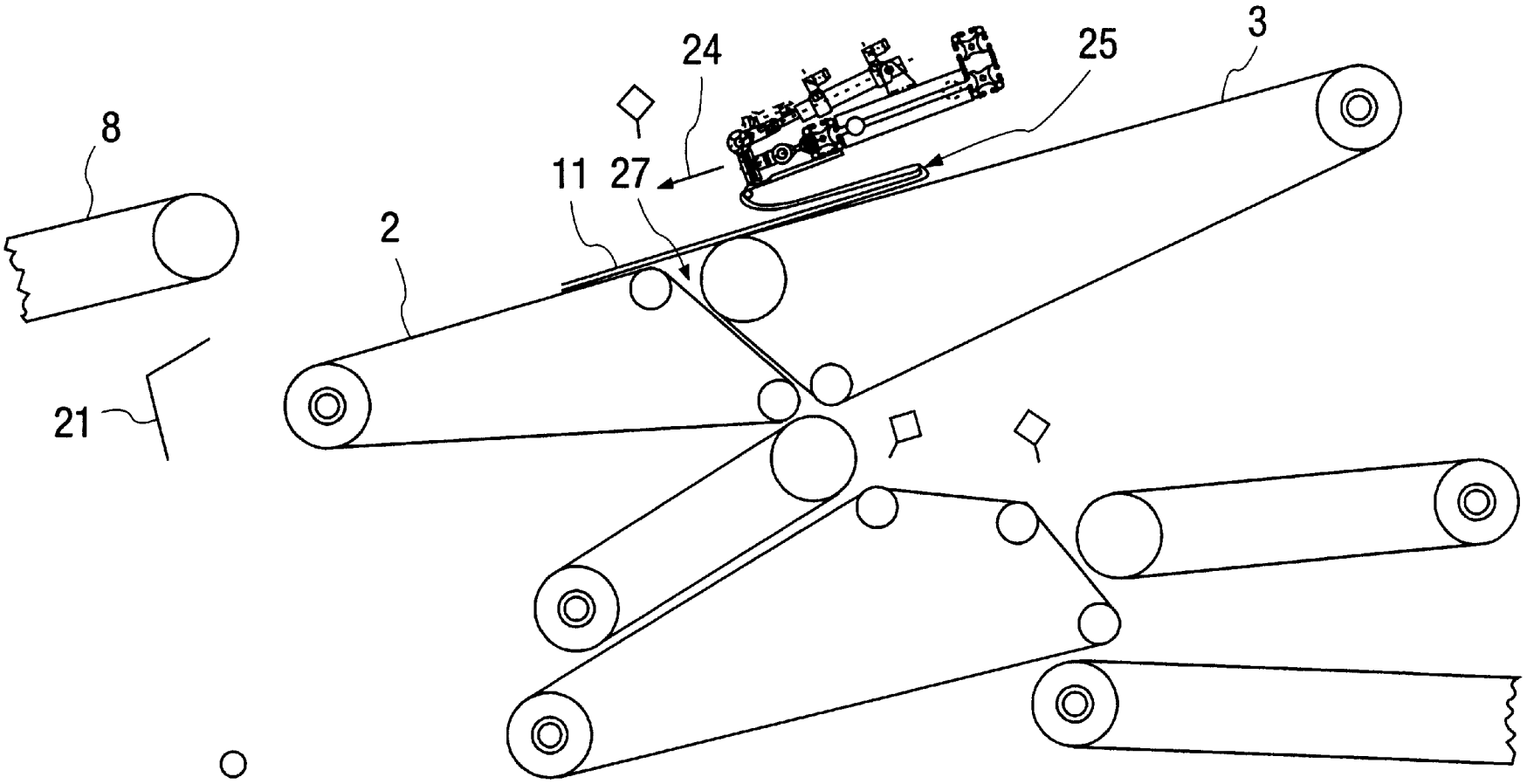
FIG. 4 is a side view of the apparatus according to FIG. 1 in a fourth method phase.

It can be seen in FIG. 4 that, having reached the end point 28, the carriage 6 is driven according to the movement arrow 24 in the opposite direction, so that an additional folding edge 25 is formed. The carriage 4 can be reciprocated several times, depending on the processing task, so that a new folding edge is formed each time. Finally, the gripping nippers 5 are opened, so that the fabric length 11 is disengaged from the gripping member 4 and then drawn into the gap 27 by operating the transport belts 2, 3. The fabric length 11 can subsequently be folded again in the conventional manner by means of the other transport belts 14 to 17.

While a specific embodiment of the invention has been shown and described in detail to illustrate the application of the principles of the invention, it will be understood that the invention may be embodied otherwise without departing from such principles.

What is claimed is:

1. An apparatus for folding a textile fabric length, comprising:

at least two transport belts which can be driven in opposite directions, wherein a gap is disposed between the transport belts, through which gap the fabric length can be drawn while forming a fold when the transport belts are driven in opposite directions;

a gripping member disposed above said two transport belts, said gripping member being movable substantially parallel to an upper side of said transport belts and is movable to lie between a front and a back end of the unfolded fabric length with a fixing action;

a feed device for feeding the unfolded fabric length in a freely suspended manner into a region at a side of said transport belts.

2. The apparatus according to claim 1, wherein said feed device is formed as a conveyor belt with an end which points towards said two transport belts and said gripping member is disposed at least a little above said two transport belts and said gripping member apparatus and at least at a short lateral distance from said two transport belts and said gripping member.

3. The apparatus according to claim 1, further comprising a mobile pushing mechanism disposed below the feed device, said pushing mechanism being brought to lie on a side of an unfolded fabric length which points away from the apparatus, wherein the fabric length can be brought to lie against the gripping member by moving the pushing mechanism.

4. The apparatus according to claim 3, wherein a shape of an edge of the unfolded fabric length at a front end is influenced by a design of a part of the mobile pushing mechanism which can be brought to lie against the unfolded fabric length.

5. The apparatus according to claim 1, further comprising a measuring member disposed below the feed device, by means of which member the vertical distance between the front end of the fabric length and the gripping member can be determined.

6. The apparatus according to claim 5, wherein the measuring member is a light barrier.

7. The apparatus according to claim 1, wherein said feed device is formed as a conveyor belt with an end which points towards said two transport belts and said gripping member is disposed at least a little above said two transport belts and said gripping member apparatus and at least at a short lateral distance from said two transport belts and said gripping member.

8. The apparatus according to claim 2, further comprising a mobile pushing mechanism disposed below the feed device, said pushing mechanism being brought to lie on a side of an unfolded fabric length which points away from the apparatus, wherein the fabric length can be brought to lie against the gripping member by moving the pushing mechanism.

9. The apparatus according to claim 2, further comprising a measuring member disposed below the feed device, by means of which member the vertical distance between the front end of the fabric length and the gripping member can be determined.

10. The apparatus according to claim 9, wherein the measuring member is a light barrier.

11. The apparatus according to claim 3, further comprising a measuring member disposed below the feed device, by means of which member the vertical distance between the front end of the fabric length and the gripping member can be determined.

12. The apparatus according to claim 11, wherein the measuring member is a light barrier.

13. A method for folding a fabric length in an apparatus with at least two transport belts which can be driven in opposite directions, wherein a gap is disposed between the transport belts, through which gap the fabric length is drawn while forming a fold when the transport belts are driven in opposite directions, and a gripping member is disposed above the two transport belts and can move substantially parallel to the upper side of the transport belts, the method comprising the steps of:

feeding the fabric length laterally to the transport belts in a freely suspended manner;

bringing the gripping member to lie against the unfolded fabric length between the front and the back end of the fabric length with a fixing action;

moving the gripping member laterally up to an end point while forming a fabric length which is folded once and lies in two layers;

disengaging the fabric from the gripping member;

drawing the fabric length into the gap disposed between the transport belts while forming a further fold by driving the transport belts in opposite directions.

14. The method according to claim 13, wherein, after reaching the end point the gripping member is moved in the opposite direction while forming a fabric length which is folded twice and lies in four layers, at least in certain regions.

15. The apparatus according to claim 3, wherein a shape of an edge of the unfolded fabric length at a front end can be influenced by one of a design and a direction of movement of a part of the mobile pushing mechanism which can be brought to lie against the unfolded fabric length.

* * * * *